United States Patent [19]

Striggow

[11] 4,187,954

[45] Feb. 12, 1980

[54] BEVERAGE CONTAINER LID

[76] Inventor: Lewis J. Striggow, 450 Demode Rd., Holly, Mich. 48442

[21] Appl. No.: 4,677

[22] Filed: Jan. 19, 1979

[51] Int. Cl.[2] ..... B65D 41/32

[52] U.S. Cl. ..... 220/90.4; 215/253; 222/541; 229/7 R

[58] Field of Search ..... 220/90.2, 90.4, 90.6, 220/268, 270; 229/7 S, 7 R; 215/253, 254; 222/541

[56] References Cited

U.S. PATENT DOCUMENTS

| | | | |
|---|---|---|---|
| D. 233,972 | 12/1974 | Juhlin | 220/90.4 X |
| 2,324,338 | 7/1943 | Tripp | 222/541 |
| 3,171,580 | 3/1965 | Davis | 220/90.2 X |
| 3,933,264 | 1/1976 | Rossi | 229/7 R X |
| 4,106,652 | 8/1978 | Leclabart | 215/253 |
| 4,113,135 | 9/1978 | Yamazaki | 229/7 R X |

FOREIGN PATENT DOCUMENTS

| | | | |
|---|---|---|---|
| 1296038 | 5/1962 | France | 220/270 |

*Primary Examiner*—Donald F. Norton
*Attorney, Agent, or Firm*—Fisher, Gerhardt & Groh

[57] ABSTRACT

A lid for a beverage container which makes possible emptying the contents of the container without removing the lid through a small opening formed in the lid and separated therefrom by a line of weakening. The cover member is formed in an elevated spout member and can be removed by distorting the cover member with either the fingers or the teeth to rupture the line of weakening for removal of the cover. This results in an opening in alignment with the inner wall of the container so that the entire contents can be drained without completely inverting the container.

5 Claims, 5 Drawing Figures

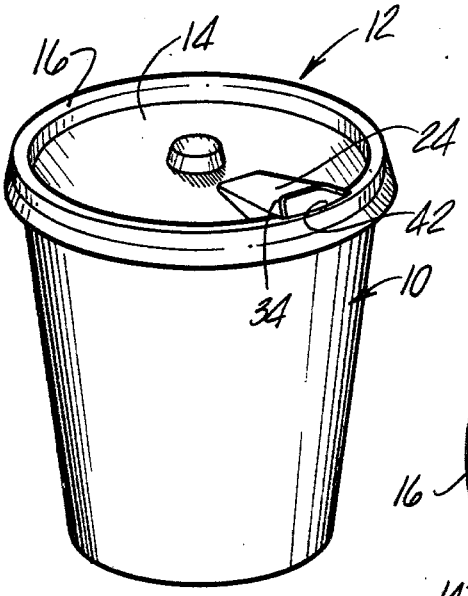
Fig-1
Fig-2
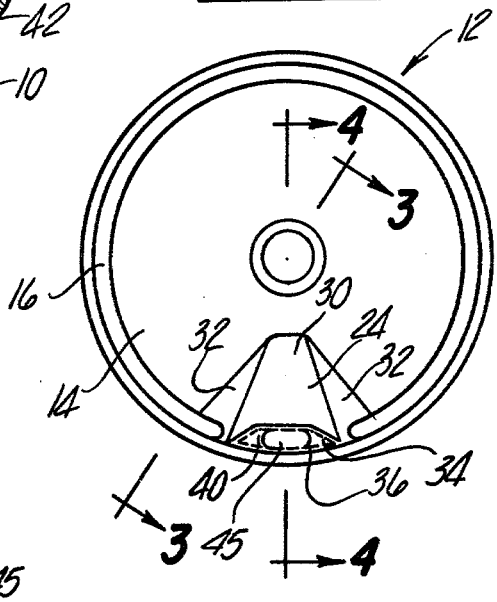
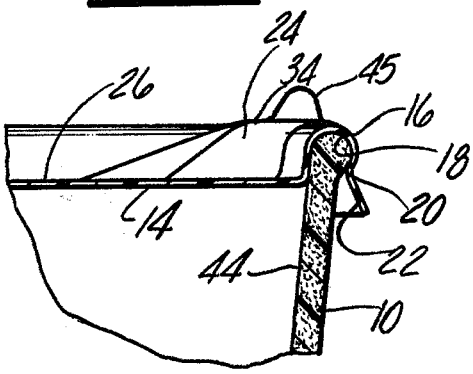
Fig-3
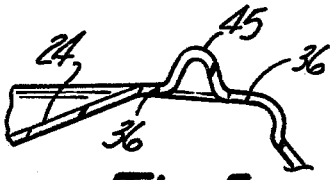
Fig-5
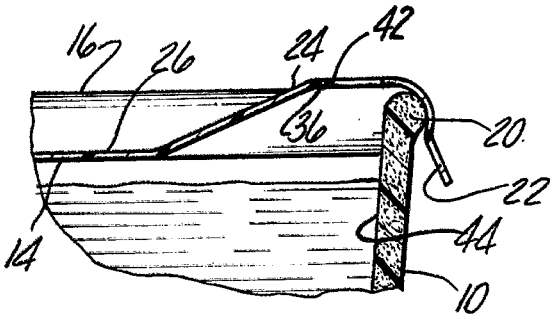
Fig-4

BEVERAGE CONTAINER LID

This invention relates to lids for containers and more particularly to a lid or closure for disposable drinking cups.

A variety of closures or lids for drinking cups have been provided usually with arrangements to receive straws enabling the contents of the cups to be drained without removing the lid.

The advantages of a covered drinking cup to prevent spillage, to prevent contamination by sand, insects etc. and to maintain the temperature of the contents all are well known. Typically the prior art arrangements are concerned with formation of openings in the covers for receiving straws and the like by which the contents of the cup can be drained. In almost all of such arrangements two hands are required to form an opening for dispensing the beverage from the cup. One hand is required to hold the container and the other hand to form the opening either with the straw or with a finger to break a line of weakening.

It is an object of the invention to provide a lid for a beverage container in which the contents can be consumed either through a straw or by drinking directly from the container without removing the closure or lid.

Another object of the invention is to provide a lid for beverage containers in which a small cover is removed to provide an opening immediately adjacent the wall of the container so that all of the contents of the container can be drained by drinking directly from the cup, by pouring from the cup or by the use of a straw passing through the opening.

It is a further object of the invention to provide a lid for a drinking beverage container in which an opening for draining the contents of the container is formed either by use of the fingers or can be formed by use of only one hand to hold the container and using the teeth by grasp and remove the cover.

The objects of the invention are accomplished by a closure for a cylindrical beverage container which has a generally disc shaped horizontal wall member with means adjacent the circumference of the wall member to detachably secure the wall to the container to close the container opening. The wall member is formed with a spout member having a smaller cover portion defined by a line of weakening such that when the cover is removed, a small aperture is formed in the closure through which the contents of the container can be drained either by drinking directly from the cup, by the use of straws or by pouring. The cover portion includes an elevated tab which is ruptured with either the fingers or the teeth distorted to rupture the line of weakening at least partially so that subsequently the cover member can be completely separated along the line of weakening and removed with either the fingers or the teeth.

These and other objects of the invention will be apparent from the following description and from the drawings in which:

FIG. 1 is a perspective view of a beverage container covered by a lid embodying the invention;

FIG. 2 is a top view of the lid;

FIG. 3 is a cross-sectional view taken on line 3—3 in FIG. 2;

FIG. 4 is a cross-sectional view taken on line 4—4 in FIG. 2 with the lid in an open condition.

FIG. 5 is a portion of the showing in FIG. 4 with the lid in a closed condition.

Referring to the drawings, a cylindrical beverage container 10 has its upper open end covered with a lid embodying the invention and designated generally at 12. The lid 12 is disc-shaped having a generally flat wall portion 14 and a circumferential edge or lip 16 which forms an annular groove 18 adapted to receive a bead 20 around the perimeter of the open end of the container 10. A flange portion 22 acts to guide the bead 20 into the annular groove 18 when the lid 12 is being placed on the container 10 and the resiliency of the lid, which can be made of plastic material, serves to maintain the lid 12 in position on the container 10. If it is desired to remove the lid 12 the flange 22 is raised relative to the container 10 at one or more points around the periphery of the lid 12.

Referring now to FIGS. 2, 3, and 4, a drinking portion or spout member 24 is formed on the upper surface 26 of the wall portion 14 of the lid 12 has a central wall surface 30 and side walls 32 which merge with each other and the wall portion 14 and present a flat upper wall 34 at or above the upper level of the circumferential lip 16. The upper wall 34 is provided with a line of weakening 36 by scoring or partial perforations to define a cover portion 40. Removal of the cover 40 by severing along the line of weakening 36 and removal of the cover portion 40 presents an opening 42. The opening 42 communicates directly with the interior of the container 10 and a radially outward edge of the opening 42 is aligned with the inner surface 44 of the container wall. The opening 42 is elongated and has its major axis extending generally circumferentially of the perimeter of the closure or lid 12.

The cover 40 has a raised portion or tab 45 elevated above the wall 34 as seen in FIGS. 3 and 5. The tab 45 makes it possible to rupture the line of weakening 36 by distorting it. This can be accomplished easiest by squeezing the tab 45 between the fingers or teeth sufficiently to distort it. When such distortion occurs, the line of weakening ruptures at least partially so that the cover 40 and tab 45 can be better grasped with the fingers or the teeth to complete the rupture of the line of weakening 36 for complete removal of the cover 40.

As seen in FIG. 5, tab 45 is elevated above the cover 40 and is dome shaped with slanted sides to facilitate stacking or nesting of multiples of the lids 12 in a minimum of space.

The tab 45 makes it possible for the container 10 to be held in one hand or to be supported on a table or the like so the tab 45 can be grasped between the fingers and used to lift the cover member 40 which will separate along the line of weakening 36. This is facilitated by the location of the oblong tab 45 which has radial opposite edges disposed adjacent to the line of weakening. The tab 45 is so shaped that its major axis extends generally circumferentially adjacent the edge of lid 18 and makes it possible to hold the cup in one hand and use an overbite of the upper teeth to distort the tab 45 and rupture the line of weakening so that the cover portion 40 can be removed to expose the opening 42.

The exposed opening 42 makes it possible to insert straws for consuming the contents of the container 10 or if preferred, the contents can be consumed by drinking directly from the opening 42. Also, if desired, the container can be tipped to pour the contents from the opening 42 and because of the location of the opening 42 immediately adjacent to the inner wall 44 all of the contents can be discharged through opening 42 without removing cover 12 by pouring without necessitating complete inverting of the container.

The lid 12 including the spout 24, cover 34, and tab 45 can be molded of plastic in a single thin layer.

A closure or lid for beverage containers has been provided making it possible to empty the contents of the container directly with the mouth in engagement with the container and cover, by the use of straws or by pouring the contents from the container, all without removing the container closure so that the contents remain protected from contamination and temperature changes and spillage is avoided. The closure is provided with a spout member having an opening in alignment with the wall of the container so that drinking of the contents or pouring can be accomplished without completely inverting the container to get complete draining of the contents. Initially the container is completely closed and a small opening for dispensing the container contents is formed by separating a cover portion from the remainder of the closure along a score line or line of weakening either with the fingers or with the teeth. The cover portion has an elevated tab which is distorted to rupture a line of weakening and facilitate grasping of the cover member for its removal. The necessary distortion and grasping of the cover member can be accomplished by either the fingers or the teeth of the user.

The embodiments of the invention in which an exclusive property or privilege is claimed are defined as follows:

1. A lid for a cylindrical beverage container comprising: a disc-shaped horizontal wall member, means adjacent the circumferential edge of said wall member adapted to detachably secure said wall to said container to close the opening therein, a spout member formed in said wall and extending above the surface of said wall, a covered portion formed in the top of said spout member, said covered portion having a perimeter defined by a line of weakening, said cover portion being removable from said spout member upon separating said cover portion at said line of weakening to form an opening in said spout for drinking through said spout from said container, a tab formed on the top of said cover portion and being deflectable to rupture said line of weakening with fingers or teeth to remove said cover portion from said spout member.

2. The combination of claim 1 wherein said tab is elevated above said cover portion and is dome shaped to facilitate nesting of said lids.

3. A lid for a cylindrical beverage container comprising: a dis-shaped horizontal wall member, means adjacent the circumferential edge of said wall member adapted to detachably secure said wall to said container to close the opening therein, a spout member formed in said wall and extending above the surface of said wall, a covered portion formed in said spout member and having a perimeter defined by a line of weakening, said cover portion being removable from said spout member upon separating said cover poriton at said line of weakening to form an opening for drinking from said container, a tab formed on said cover portion and being deflectable to rupture said line of weakening with fingers or teeth to remove said cover portion, said cover portion being adjacent the edge of said wall member and having at least a portion of the perimeter of said cover portion in alignment with the inner wall of said container.

4. A lid for a cylindrical beverage container comprising: a disc-shaped horizontal wall member, means adjacent the circumferential edge of said wall member adapted to detachably secure said wall to said container to close the opening therein, a spout member formed in said wall and extending above the surface of said wall, a covered portion formed in said spout member and having a perimeter defined by a line of weakening, said cover portion being removable from said spout member upon separating said cover portion at said line of weakening to form an opening for drinking from said container, and a tab formed on said cover portion and being deflectable to rupture said line of weakening with fingers or teeth to remove said cover portion, said opening being elongated with its major axis extending generally circumferentially of said cover.

5. A lid for a cylindrical beverage container comprising: a disc-shaped horizontal wall member, means adjacent the circumferential edge of said wall member adapted to detachably secure said wall to said container to close the opening therein, a spout member formed in said wall and extending above the surface of said wall, a covered portion formed in said spout member and having a perimeter defined by a line of weakening, said cover portion being removable from said spout member upon separating said cover portion at said line of weakening to form an opening for drinking from said container, and a tab formed on said cover portion, said tab having a portion formed proximate to said line of weakening and said tab being oblong and having it major axis proximate to the perimeter of said closure to facilitate distorting said tab and rupturing said line of weakening with the use of the drinkers teeth.

* * * * *